US007178898B2

(12) United States Patent
Hoshino

(10) Patent No.: US 7,178,898 B2
(45) Date of Patent: Feb. 20, 2007

(54) INKJET RECORDING APPARATUS

(75) Inventor: Yoshihide Hoshino, Hachioji (JP)

(73) Assignee: Konica Minolta Medical & Graphic Inc., Tokyo (JP)

( * ) Notice: Subject to any disclaimer, the term of this patent is extended or adjusted under 35 U.S.C. 154(b) by 0 days.

(21) Appl. No.: 11/024,606

(22) Filed: Dec. 29, 2004

(65) Prior Publication Data

US 2005/0157067 A1 Jul. 21, 2005

(30) Foreign Application Priority Data

Jan. 16, 2004 (JP) ..... 2004-009214

(51) Int. Cl.
*B41J 2/145* (2006.01)
*B41J 2/15* (2006.01)

(52) U.S. Cl. ..... 347/40; 347/21; 347/95

(58) Field of Classification Search ..... None
See application file for complete search history.

(56) References Cited

U.S. PATENT DOCUMENTS 5,635,969 A * 6/1997 Allen ..... 347/96
6,264,320 B1 * 7/2001 Moriyama et al. ..... 347/101
6,877,850 B2 * 4/2005 Ishimoto et al. ..... 347/100

FOREIGN PATENT DOCUMENTS

JP 2001-310454 A 11/2001
JP 2003-191601 A 7/2003

* cited by examiner

*Primary Examiner*—Thinh Nguyen
(74) *Attorney, Agent, or Firm*—Frishauf, Holtz, Goodman & Chick, P.C.

(57) ABSTRACT

An inkjet recording apparatus including: a colored ink recording head for emitting photocurable colored ink to a recording medium; a transparent ink recording head for emitting the transparent ink to a recording medium; and a control device for controlling the colored ink recording head and transparent ink recording head; wherein the control device controls an amount of the ink for printing per unit area emitted by the transparent ink recording head according to a relationship between an amount A of colored ink for printing per unit area and an amount B of transparent ink for printing per unit area, and wherein the relationship is that, the amount B is decreased by an increase in the amount A.

6 Claims, 7 Drawing Sheets

INKJET RECORDING APPARATUS

FIELD OF THE INVENTION

The present invention relates to an inkjet printer recording apparatus, particularly to an inkjet printer recording apparatus using photocurable ink.

BACKGROUND OF THE INVENTION

In an inkjet printer recording apparatus having been used according to the prior art, ink is emitted onto such a recording medium as paper and a plastic sheet to record an image. In the inkjet printer recording apparatus, the amount of ink for printing in each color is determined in conformity to the inputted gradation value (wherein the amount of ink for printing refers to the number of emissions of ink particles per unit area, in the volume of ink particles is always constant). Based on the amount of ink determined in this manner, ink is emitted.

To ensure that an image can be recorded also on the recording medium that does not absorb ink, an inkjet printer recording apparatus has been developed in recent years, wherein photocurable ink is used, and the ink having reached a recording medium is exposed to light such as an ultraviolet ray, whereby an image is recorded. Such an inkjet printer recording apparatus includes an apparatus wherein radical polymerized ink is used and a large quantity of ultraviolet rays is collectively applied (e.g. Official Gazette of Japanese Patent Tokkai 2001-310454).

When photocurable non-absorbing ink is used, the ink having reached the recording medium is cured in a raised form, and the image recorded on the recording medium appears gritty or rugged. To reduce the gritty, rugged and excessively glossy appearance of the image, an inkjet printer recording apparatus has been developed wherein transparent ink is used to record an image (Official Gazette of Japanese Patent Tokkai 2003-191601).

However, even if transparent ink is used to record the image, some part of the image is too glossy and other portions are not sufficiently glossy. The prior art has failed to provide uniform glossiness of an image. It is thought to be aftereffects of difference of the relationship between an amount of ink for printing per unit area and the glossiness.

SUMMARY OF THE INVENTION

According to one embodiment of the present invention, an inkjet recording apparatus is provided that the ink jet recording apparatus may include a couple of ink recording heads and control device. The control device may provide control in such a way that the amount of the ink for printing per unit area emitted by one of the ink recording head is determined according to the relationship. The relationship is that the amount B emitted by one of the head for printing per unit area is decreased by an increase in the amount A emitted by other head for printing per unit area.

According to another embodiment of the present invention, The relationship is that the amount A emitted by one of the heads for printing per unit area is equal to or greater than first threshold value $A_1$ and is equal to or smaller than the second threshold value $A_2$, the amount B emitted by other head for printing per unit area is increased by an increase in the amount A, and is that the amount A emitted by one of the heads for printing per unit area is equal to or greater than second threshold value $A_2$ and is equal to or smaller than the third threshold value $A_3$, the amount B emitted by other head for printing per unit area is decreased by an increase in the amount A.

According to another embodiment of the present invention, the inkjet printer recording apparatus of the present invention may comprise a gloss measuring instrument for measuring the glossiness of a recording medium. The control device may provide control in such a way that the first or second mode is selected based on the glossiness measured by the gloss measuring instrument.

DETAILED DESCRIPTION OF THE PREFERRED EMBODIMENT

Figure 1:
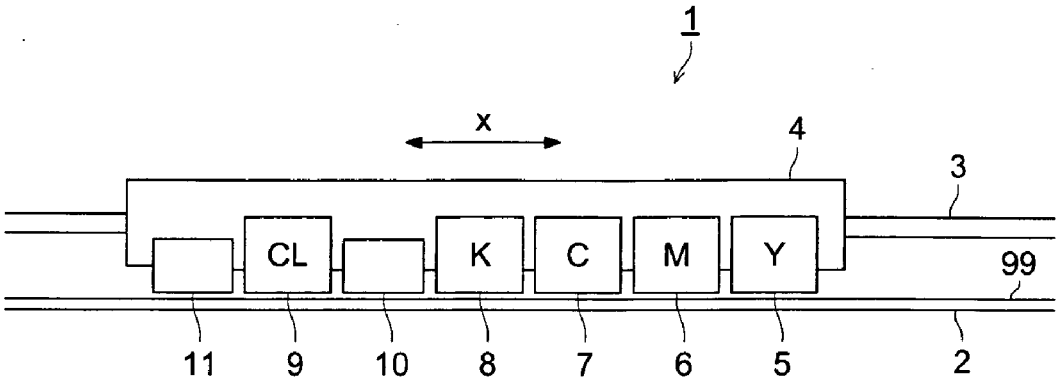
FIG. 1 is a front view of an inkjet printer recording apparatus 1.

The present invention has been made to solve the aforementioned problems. The effect of the present invention is to provide an inkjet printer recording apparatus capable of ensuring uniform glossiness on the surface of an image without relying on the characteristics of recording members.

To solve the aforementioned problems, an inkjet printer recording apparatus of the present invention comprises:

a colored ink recording head for emitting photocurable colored ink to a recording medium;

a colored ink recording head for emitting transparent ink to a recording medium; and a control apparatus for controlling the aforementioned colored ink recording head and transparent ink recording head; wherein the control apparatus provides control in such a way that the amount of the ink for printing per unit area emitted by the transparent ink recording head is determined according to the relationship wherein the amount of transparent ink for printing per unit area B is decreased by an increase in the amount of colored ink for printing per unit area A.

The inkjet printer recording apparatus of the present invention comprises:

a colored ink recording head for emitting photocurable colored ink to a recording medium;

a colored ink recording head for emitting transparent ink to a recording medium; and a control apparatus for controlling the aforementioned colored ink recording head and transparent ink recording head; wherein the control apparatus provides control in such a way that the amount of the transparent ink for printing per unit area emitted by the transparent ink recording head is determined according to the relationship wherein:

where the amount of colored ink for printing per unit area A is equal to or greater than first threshold value $A_1$ and is equal to or smaller than the second threshold value $A_2$, the amount of transparent ink for printing per unit area B is increased by an increase in the amount of colored ink for printing per unit area A; whereas, where the amount of colored ink for printing per unit area A is equal to or greater than second threshold value $A_2$ and is equal to or smaller than the third threshold value $A_3$, the amount of transparent ink for printing per unit area B is decreased by an increase in the amount of colored ink for printing per unit area A.

The inkjet printer recording apparatus of the present invention comprises:

a colored ink recording head for emitting photocurable colored ink to a recording medium;

a colored ink recording head for emitting transparent ink to a recording medium;

a control apparatus for controlling the aforementioned colored ink recording head and transparent ink recording head; and a gloss measuring instrument for measuring the glossiness of a recording medium;

wherein the control apparatus provides control in such a way that the first or second mode is selected based on the glossiness measured by the aforementioned gloss meter; and if the first mode has been selected, the amount of ink for printing per unit area emitted from the transparent ink recording head is determined according to the relationship wherein the amount of transparent ink for printing per unit area B is decreased by an increase in the amount of colored ink for printing per unit area A; and if the second mode has been selected, the amount of the transparent ink for printing per unit area emitted by the transparent is recording head is determined according to the relationship wherein:

where the amount of colored ink for printing per unit area A is equal to or greater than first threshold value $A_1$ and is equal to or smaller than the second threshold value $A_2$, the amount of transparent ink for printing per unit area B is increased by an increase in the amount of colored ink for printing per unit area A; whereas, where the amount of colored ink for printing per unit area A is equal to or greater than second threshold value $A_2$ and is equal to or smaller than the third threshold value $A_3$, the amount of transparent ink for printing per unit area B is decreased by an increase in the amount of colored ink for printing per unit area A.

Referring to the drawings, the following describes the best forms of the embodiments of the present invention. The following embodiments are accompanied by various restrictions technically preferable for the embodiment of the present invention. It should be noted, however, that the scope of the present invention is not restricted to these embodiments or illustrations.

[Embodiment 1]

Figure 2:
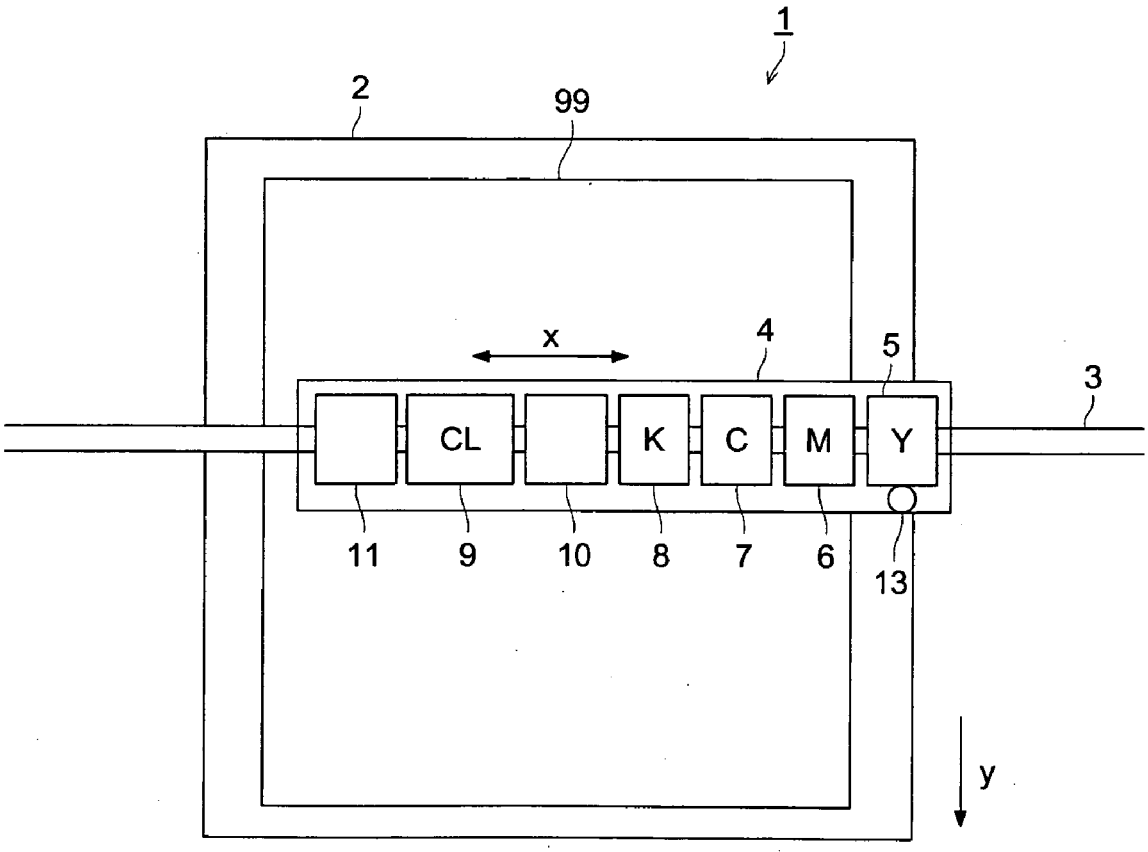
FIG. 2 is a plan view of an inkjet printer recording apparatus 1.
Figure 3:
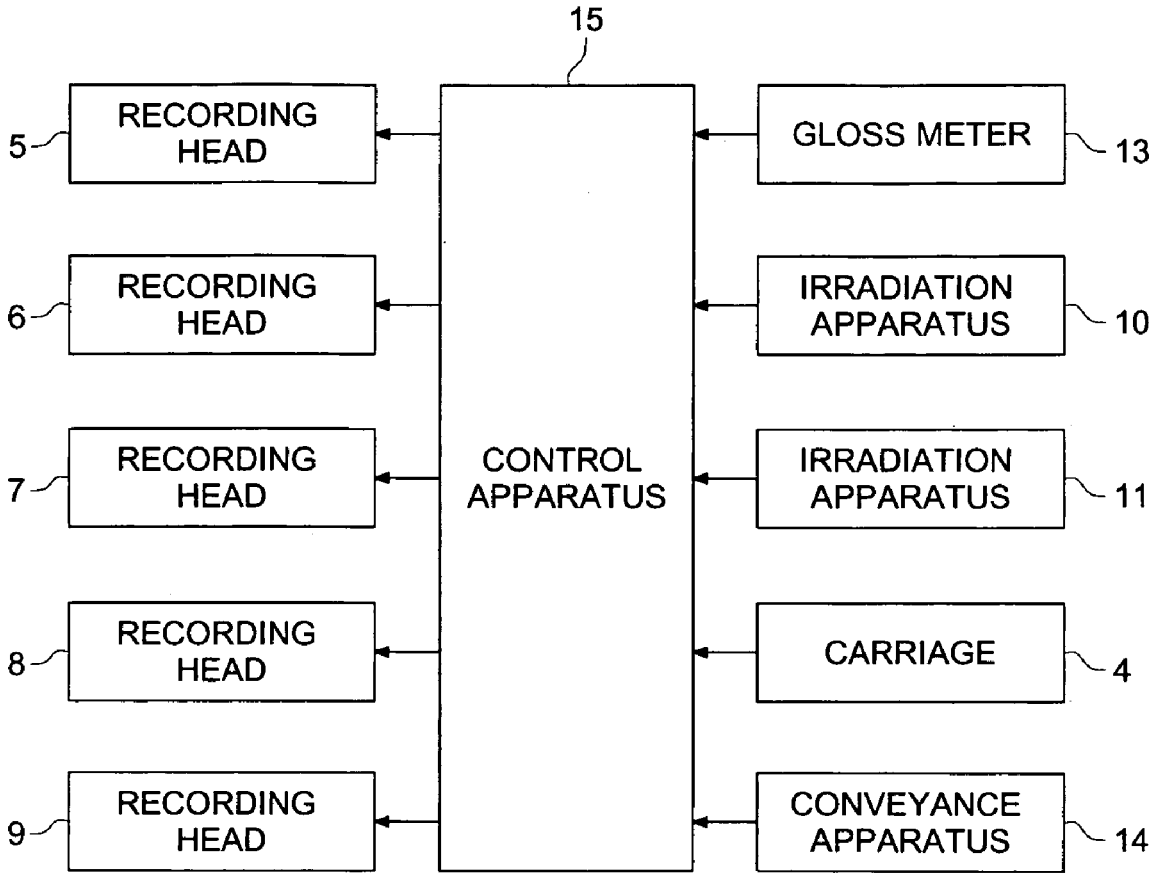
FIG. 3 is a block diagram representing the control circuit of an inkjet printer recording apparatus 1.

FIG. 1 is a front view of an inkjet printer recording apparatus 1 as an embodiment of the present invention. FIG. 2 is a top view of this inkjet printer recording apparatus 1. FIG. 3 is a block diagram representing the control circuit of this inkjet printer recording apparatus 1.

As shown in FIGS. 1, 2 and 3, the inkjet printer recording apparatus 1 comprises:

a platen 2 formed in a flat plate, a guide member 3, above the platen 2, arranged parallel to the platen 2, a carriage 4 supported and guided by the guide member 3, recording heads 5 through 9 mounted on the carriage 4, ultraviolet irradiation apparatuses 10 and 11 mounted on the carriage 4, a gloss meter 13 mounted on the carriage 4, a conveyance apparatus 14 for conveying a web-shaped recording medium 99 in the direction orthogonal to the guide member 3 and for allowing the web-shaped recording medium 99 pass from the back surface of the inkjet printer recording apparatus 1 over to the front above the platen 2, and a control apparatus 15 for controlling the recording heads 5 through 9, ultraviolet irradiation apparatuses 10 and 11, conveyance apparatus 14 and gloss meter 13. In the following description, the scanning direction x is defined as the direction where the carriage 4 travels along the guide member 3, and the conveyance direction y is defined as the direction where the recording medium 99 is conveyed.

The conveyance apparatus 14 is equipped with a conveyance motor and a conveyance roller. The conveyance roller is rotated by the drive of the conveyance motor, whereby the recording medium 99 is conveyed. Further, the conveyance apparatus 14 designed to convey the recording medium 99 on an intermittent basis.

The platen 2 supports the recording medium 99 from below.

The carriage 4 is arranged movably along the guide member 3 in the scanning direction x.

The recording heads 5 through 9 are arranged in the order of a transparent ink recording head 9, a colored ink recording head 8, a colored ink recording head 7, colored ink recording head 6 and colored ink recording head 5, as viewed from the left in FIG. 1 in the scanning direction x. The recording heads 5 through 9 are mounted on the carriage 4 so that each lower surface will be positioned face to face with the recording medium 99 on the platen 2. The lower surface of each of the recording heads 5 through 9 is provided with a plurality of ink outlets for emitting ink. Each ink outlet is provided with an element (such as a piezoelectric element, heating element, electrostatic element). The recording heads 5 through 9 are designed to allow ink as ink particles to be emitted separately from each outlet by the operation of such an element.

The ink emitted from the recording heads 5 through 9 is an ultraviolet cure ink to be cured when exposed to ultraviolet rays. Either cation polymerizable ink or radical polymerizable ink can be used. Of these recording heads, recording heads 5 through 9 are intended to emit colored ink containing a coloring agent. The transparent ink recording head 9 emits the transparent (CL) ink that does not include any coloring agent. Especially the colored ink recording head 5 emits the yellow (Y) ink, the colored ink recording head 6 the magenta (M) ink, the colored ink recording head 7 the cyan (C) ink, and the colored ink recording head 8 the black (K) ink. The colored ink recording head for emitting the ink colored in other than YMCK may be mounted on the carriage 4.

The ultraviolet irradiation apparatuses 10 and 11 are designed to allow the light containing the ultraviolet range to be applied to the recording medium 99 located below. The ultraviolet irradiation apparatuses 10 and 11 are arranged in the scanning direction x in the order of ultraviolet irradiation apparatus 11 and ultraviolet irradiation apparatus 10. The transparent ink recording head 9 is arranged between the ultraviolet irradiation apparatuses 10 and 11 in the scanning direction x. The ultraviolet irradiation apparatus 10 is arranged between the transparent ink recording head 9 and colored ink recording head 8 in the scanning direction x. In FIG. 1, it is also possible to make such arrangements that that an ultraviolet irradiation apparatus is located on the right of the colored ink recording head 5, a transparent ink recording head is installed on the right of the ultraviolet irradiation apparatus, and an ultraviolet irradiation apparatus is mounted on the right of the transparent ink recording head. This arrangement allows an image to be recorded whether the carriage 4 moves from left to right, or from right to left.

The gloss meter 13 is arranged downstream in the conveyance direction y of the colored ink recording head 5. Light is projected at a predetermined incident angle (e.g. 45 and 60 deg.) toward the recording medium 99, whereby this gloss meter 13 measures the glossiness of the recording medium 99 (where glossiness corresponds to the reflection factor of the recording medium 99 at, the predetermined angle). To be more specific, the gloss meter 13 measures the glossiness of the recording medium 99 according to JIS Z 8741. Further, the gloss meter 13 outputs the result of measurement to the control apparatus 15 in the form of an electric signal conforming to the glossiness of the recording medium 99.

The control apparatus 15 comprises:

a CPU, a ROM storing the control program readable to the CPU, a RAM for providing a CPU work area, an interface for inputting the measurement of glossiness from the gloss meter 13, and a drive circuit for driving each of the carriage 4, recording heads 5 through 9, and conveyance apparatus 14 in response to the instruction of the CPU conforming to the control program.

Figure 4:
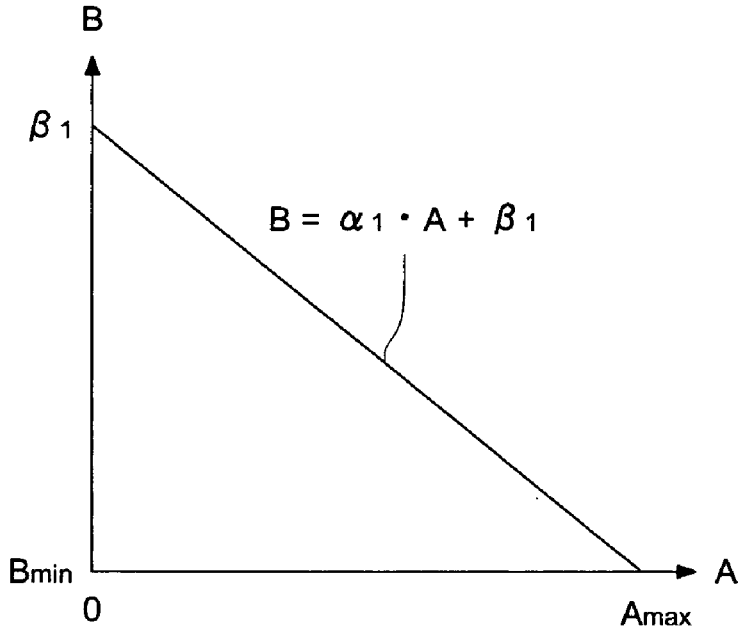
FIG. 4 is a chart representing the relationship between the overall amount of ink for printing A and the amount of ink for printing B.

The control apparatus 15 allows the ROM to store the relationship of the amount of transparent ink for printing per unit area B, with respect to the overall amount of YMCK-colored ink for printing per unit area A, as shown in the chart of FIG. 4. In FIG. 4, the horizontal axis represents the overall amount of YMCK-colored ink for printing per unit area A, while the vertical axis shows the amount of transparent ink for printing per unit area B. The overall amount of ink for printing A is zero at the origin in the chart, and the amount of ink for printing B takes the minimum values $B_{min}$. (e.g. zero). As shown in FIG. 4, this relationship shows that the amount of ink for printing B is decreased as the overall amount of ink for printing A is increased. To be more specific, the amount of ink for printing B is a linear function of the overall amount of ink for printing A. Especially, the relationship of the chart in FIG. 4 can be expressed as follows:

$$B=\alpha_1 \cdot A+\beta_1 \quad (1)$$

where $\alpha_1<0$, and $\beta_1>0$, and both $\alpha_1$ and $\beta_1$ are constant.

The relationship between the overall amount of ink for printing A and the amount of ink for printing B expressed by Eq. (1) is one used in the first mode to be described later. Further, the relationship of the chart in FIG. 4 can be stored in the ROM in the form of a data table of the amount of ink for printing B with respect to the overall amount of ink for printing A, or can be stored in the ROM as an Equation expressed by $\alpha_1$ and $\beta_1$, as in the case of the Eq. (1). If the relationship is such that the amount of ink for printing B decreases with the increase of the overall amount of ink for printing A, the amount of ink for printing B need not necessarily be a linear function of the overall amount of ink for printing A.

The amount of ink for printing per unit area refers to the overall amount of ink emitted per unit area—not the amount of ink emitted in one operation. Suppose that the amount of ink emitted in one operation is constant. Then the value obtained by multiplying that amount by the number of emissions of ink per unit area is the amount of ink for printing.

Figure 5:
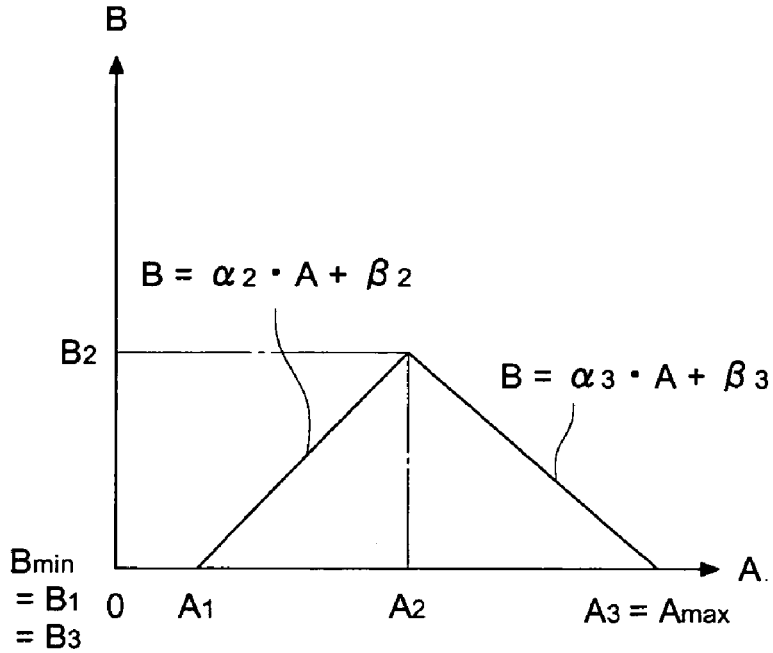
FIG. 5 is a chart representing the relationship between the overall amount of ink for printing A and the amount of ink for printing B.

As shown in the graph of FIG. 5, the control apparatus 15 provides control in such a way that the overall amount of transparent ink for printing per unit area B, with respect to the overall amount of YMCK-colored ink for printing per unit area A is stored in the ROM. Here in FIG. 5, the horizontal axis represents the overall amount of YMCK-colored ink for printing per unit area A, and the vertical axis shows the amount of transparent ink for printing per unit area B. The overall amount of ink for printing A is zero at the origin in the chart, and the amount of ink for printing B takes the minimum values $B_{min}$. (e.g. zero). According to this relationship shown in FIG. 5, when the overall amount of ink for printing A is equal to or greater than 0, and equal to or smaller than the first threshold value $A_1$, the amount of ink for printing B is the minimum value $B_{min}$., despite the overall amount of ink for printing A. When the overall amount of ink for printing A is equal to or greater than the first threshold value $A_1$ or more, and equal to or smaller than the second threshold value $A_2$, the amount of ink for printing B increases as the overall amount of ink for printing A increases. When the overall amount of ink for printing A is equal or greater than the second threshold value $A_2$ and is equal to or smaller than the third threshold value $A_3$, the amount of ink for printing B decreases as the overall amount of ink for printing A increases. In the chart of FIG. 5, independently of whether the value is equal to or greater than the first threshold value $A_1$, and equal to or smaller than the second threshold value $A_2$, or is equal to or greater than the second threshold value $A_2$ and equal to or smaller than the third threshold value $A_3$, the amount of ink for printing B is the linear function of the overall amount of ink for printing A. Especially the relationship of the chart in FIG. 5 can be expressed by the following Equation:

$$B=B_{min}\ (0\leqq A\leqq A_1),\ B=\alpha_2 \cdot A+\beta_2\ (A_1\leqq A\leqq A_2),\ B=\alpha_3 \cdot A+\beta_3\ (A_2\leqq A<A_3) \quad (2)$$

where $\alpha_2>0$, $\beta_2<0$, $\alpha_3<0$, $\beta_3>0$, $\alpha_2 \cdot A_2+\beta_2=\alpha_3 \cdot A_2+\beta_3$, and $\alpha_2 \cdot A_1+\beta_2=\alpha_3 \cdot A_3+\beta_3=\beta_{min}$, $\alpha_2$, $\beta_2$, $\alpha_3$ and $\beta_3$ are constants.

The relationship between the overall amount of ink for printing A the overall amount of ink for printing A the amount of ink for printing B shown in the chart of FIG. 5 is the relationship utilized in the second mode to be described later. In the relationship of the chart in FIG. 5, the amount of ink for printing B corresponding to the first threshold value $A_1$ is assumed as the first singular value $B_1$ ($B_1=B_{min}$.), the amount of ink for printing B corresponding to the second threshold value $A_2$ is assumed as the second singular value $B_2$ ($B_2=\alpha_2 \cdot A_2+\beta_2=\alpha_3 \cdot A_2+\beta_3$), and the second singular value $B_2$ corresponding to the third threshold value $A_3$ is assumed as the third singular value $B_3$ ($B_3=B_{min}$). In the range equal to or greater than the first threshold value $A_1$ and equal to or smaller than the second threshold value $A_2$, if the amount of ink for printing B increases as the overall amount of ink for printing A increases, the amount of ink for printing B need not be a linear function of the overall amount of ink for printing A. Further, in the range equal to or greater than the second threshold value $A_2$ and equal to or smaller than the third threshold value $A_3$, if the amount of ink for printing B decreased as the overall amount of ink for printing A increases, the amount of ink for printing B need not be a linear function of the overall amount of ink for printing A.

The control apparatus 15 provides control in such a way that, when arithmetic processing conforming to the control program of the ROM is performed by the CPU, the measurement of glossiness is inputted from the gloss meter 13, the recording heads 5 through 9 emits ink, the carriage 4 travels in the scanning direction x, the conveyance apparatus 14 performs conveying operation and the ultraviolet irradiation apparatuses 10 and 11 are turned on or off.

Processing of the CPU conforming to the control program allows the control apparatus 15 to serve as a selecting means, a means for determining the amount of transparent ink and an ink emitting means as described below. Based on the glossiness of the recording medium 99 measured by the gloss meter 13, the first or second mode is selected. When the first mode is selected by the selecting means, the means for determining the amount of transparent ink reads the relationship between the overall amount of ink for printing A and the amount of ink for printing B shown in FIG. 4, from the ROM. After determining the overall amount of colored ink for printing per unit area emitted by the recording heads 5 through 8 in conformity to the image data (input gradation value) inputted from the outside, it determines the amount of transparent ink for printing per unit area emitted by the transparent ink recording head 9 in conformity to the relationship between the overall amount of ink for printing A and the amount of ink for printing B shown in the chart of FIG. 4, based on the overall amount of colored ink for printing having been determined. When the second mode has been selected, it reads the relationship between the overall amount of ink for printing A and the amount of ink for printing B as shown in the chart of FIG. 5, and determines the overall amount of colored ink for printing per unit area emitted from the recording heads 5 through 8, in conformity to the image data inputted from the outside. After that, it determines the amount of transparent ink for printing per unit area emitted from the transparent ink recording head 9 in conformity to the relationship between the overall amount of ink for printing A and the amount of ink for printing B as shown in the chart of FIG. 5, based on the overall amount of colored ink for printing having been determined. The ink emitting means allows the recording heads 5 through 8 to emit the colored ink in the overall amount of ink for printing having been determined. It allows the transparent ink recording head 9 to emit the transparent ink in the overall amount of ink for printing having been determined.

The following describes the operation of the inkjet printer recording apparatus 1:

The user sets the inkjet printer recording apparatus 1 and turns on the power of the inkjet printer recording apparatus 1. When the control apparatus 15 controls the carriage 4, the carriage 4 travels in the scanning direction x. During the travel of the carriage 4, the glossiness of the recording medium 99 is measured by the gloss meter 13 and the control apparatus 15 inputs the measured glossiness from the gloss meter 13.

Based on the measurement of the glossiness inputted from the gloss meter 13, the control apparatus 15 selects either the first or second mode. For example, if the measured glossiness inputted from the gloss meter 13 is less than a predetermined value, the control apparatus 15 selects the first mode. If the measured glossiness inputted from the gloss meter 13 is equal to or greater than a predetermined value, the control apparatus 15 selects the second mode. The glossiness of the image when recorded at the maximum amount of ink for printing can be used as the predetermined value.

When the first mode has been selected, the control apparatus 15 reads from the ROM the relationship between the overall amount of ink for printing A and the amount of ink for printing B. When the control apparatus 15 has turned on the ultraviolet irradiation apparatuses 10 and 11 and controls the conveyance apparatus 14, the conveyance apparatus 14 repeats the convey/stop operation of the recording medium 99 so that the recording medium 99 is conveyed on an intermittent basis. If the control apparatus 15 controls the carriage 4 during the conveyance of the recording medium 99, the carriage 4 performs a reciprocating motion in the scanning direction x when the recording medium 99 is stopped. Further, when the control apparatus 15 controls the recording heads 5 through 9 based on the inputted gradation value during the reciprocating motion of the carriage 4, then the recording heads 5 through 9 emits ink particles from the outlet to the recording medium 99 as required. The ink having reached the recording medium 99 is cured when exposed to the ultraviolet rays emitted from the ultraviolet irradiation apparatuses 10 and 11. Through the repetition of this procedure, an image is formed on the recording medium 99. When an image is recorded on the recording medium 99, the control apparatus 15 determines the overall amount of colored ink for printing per unit area emitted from the recording heads 5 through 8, in conformity to the image data having been inputted from the outside. After that, based on the relationship between the overall amount of ink for printing A and the amount of ink for printing B shown in the chart of FIG. 4, it determines the amount of ink for printing per unit area emitted from the transparent ink recording head 9, from the overall amount of ink for printing having been determined. Then the recording heads 5 through 8 are allowed to emit the colored ink in the determined overall amount of ink for printing. At the same time, the transparent ink recording head 9 is allowed to emit the transparent ink in the determined overall amount of ink for printing. To be more specific, for example, if the overall amount of ink for printing A conforming to the input gradation value inputted into the control apparatus 15 from an external device such as a computer is $A_{100}$, then the control apparatus 15 allows the recording heads 5 through 8 to emit the ink so as to ensure the overall amount of colored ink for printing per unit area $A_{100}$. It allows the transparent ink recording head 9 to emit the transparent ink so as to ensure the overall amount of colored ink for printing per unit area ($\alpha 1 \cdot A_{100}+\beta_1$).

When the second mode has been selected, the control apparatus 15 reads from the ROM the relationship between the overall amount of ink for printing A and the amount of ink for printing B. When the control apparatus 15 has turned on the ultraviolet irradiation apparatuses 10 and 11 and controls the conveyance apparatus 14, the conveyance apparatus 14 repeats the convey/stop operation of the recording medium 99 so that the recording medium 99 is conveyed on an intermittent basis. If the control apparatus 15 controls the carriage 4 during the conveyance of the recording medium 99, the carriage 4 performs a reciprocating motion in the scanning direction x when the recording medium 99 is stopped. Further, if the control apparatus 15 controls the recording heads 5 through 9 based on the inputted gradation value during the reciprocating motion of the carriage 4, then the recording heads 5 through 9 emits ink particles from the outlet to the recording medium 99 as required. The ink having reached the recording medium 99 is cured when exposed to the ultraviolet rays emitted from the ultraviolet irradiation apparatuses 10 and 11. Through the repetition of this procedure, an image is formed on the recording medium 99. When an image is recorded on the recording medium 99, the control apparatus 15 determines the overall amount of colored ink for printing per unit area emitted from the recording heads 5 through 8, in conformity to the image data having been inputted from the outside. After that, based on the relationship between the overall amount of ink for printing A and the amount of ink for printing B shown in the chart of FIG. 5, it determines the amount of ink for printing per unit area emitted from the transparent ink recording head 9, from the overall amount of colored ink for printing having been determined. Then the recording heads 5 through 8 are allowed to emit the colored ink in the determined overall amount of ink for printing. At the same time, the transparent ink recording head 9 is allowed to emit the transparent ink in the determined overall amount of ink for printing.

As described above, according to the present embodiment, if the glossiness of the recording medium 99 is lower than the predetermined value, the control apparatus 15 determines the overall amount of ink for printing of the recording heads 5 through 8 in conformity to the relationship shown in FIG. 4, and the amount of ink for printing of the transparent ink recording head 9. Ink is emitted in the amount of ink for printing. Because of this arrangement, an image having uniform glossiness on the inner surface can be recorded on the recording medium 99.

If the glossiness of the recording medium 99 exceeds the predetermined level, the control apparatus 15 determines the overall amount of ink for printing of the recording heads 5 through 8 and the amount of ink for printing of the transparent ink recording head 9 in conformity to the relationship shown in the chart of FIG. 5. It allows the recording heads 5 through 9 to emit ink in the amount of ink for printing in conformity to that relationship; therefore, an image having uniform glossiness on the inner surface can be recorded on the recording medium 99.

As described above, the relationship of the chart in FIG. 4 or that in FIG. 5 is determined, based on the glossiness of the recording medium 99. Consequently, an image having uniform glossiness on the inner surface can be recorded on the recording medium of any glossiness.

[Embodiment 2]

The following describes the second embodiment of the present invention. In the inkjet printer recording apparatus as a second embodiment, the portions corresponding to any portions of the inkjet printer recording apparatus 1 of the first embodiment will be assigned with the same reference numerals, and the same portions will not be described to avoid duplication. In the following description, the same reference numerals will be used to explain the inkjet printer recording apparatus as a second embodiment.

Similarly to the inkjet printer recording apparatus 1 of the first embodiment, the inkjet printer recording apparatus of the second embodiment comprises a platen 2, a guide member 3, a carriage 4, recording heads 5 through 9, ultraviolet irradiation apparatuses 10 and 11, a gloss meter 13, a conveyance apparatus 14 and a control apparatus 15.

In the first embodiment, the relationship of the Equation (1), $\alpha_1$ and $\beta_1$ are stored in the ROM as constants. If the glossiness measured by the gloss meter 13 is within the range of the first mode, the overall amount of colored ink for printing per unit area emitted by the recording heads 5 through 9 and the amount of transparent ink for printing per unit area emitted by the transparent ink recording head 9 is determined according to the relationship of the Equation (1) where $\alpha_1$ and $\beta_1$ are constants, even if there is any change in the glossiness measured by the gloss meter 13, in the first embodiment.

Figure 6:
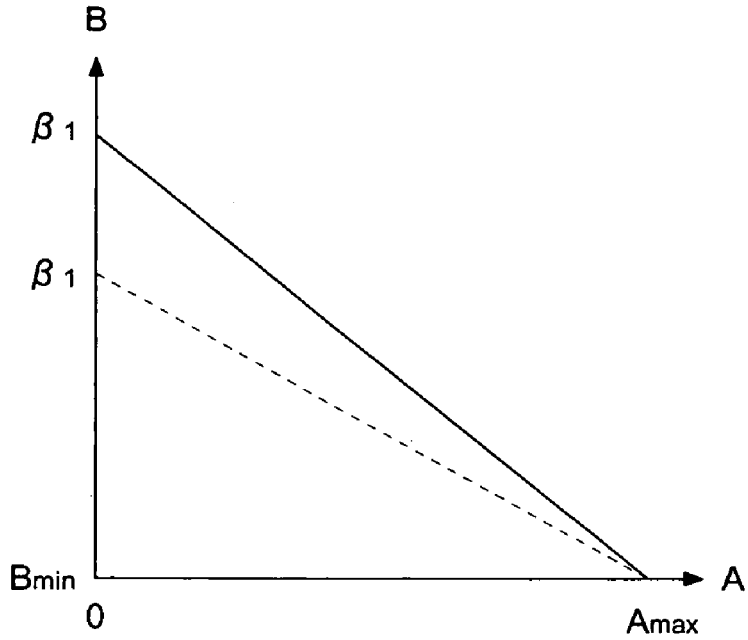
FIG. 6 is a chart representing the relationship between the overall amount of ink for printing A and the amount of ink for printing B.

In the second embodiment, by contrast, after selecting the first mode, the control apparatus 15 determines the relationship shown in the chart of FIG. 4, based on the glossiness measured by the gloss meter 13, when using the relationship shown in the chart of FIG. 4. To be more specific, in the second embodiment, $\alpha_1$ and $\beta_1$ are stored in the ROM as variables of the glossiness $\lambda$. More specifically, the relationship of the $\beta_1$ decreasing with the increase of the glossiness $\lambda$ is stored in the RAM. At the same time, the relationship of the $\beta_1$ increasing with the increase of the glossiness $\alpha_1$ is stored in the ROM. Further, independently of the value of the glossiness $\lambda$, the $\alpha_1$ and $\beta_1$ are related in such a way that the overall amount of ink for printing A will be the constant maximum value $A_{max}$ ($(B_{min}-\beta_1)/\alpha_1=A_{max}$=constant), when the amount of ink for printing B is the minimum $B_{min}$. FIG. 6 shows the relationship between the overall amount of ink for printing A and the amount of ink for printing B, graphically represented according to the relationship of the $\alpha_1$, $\beta_1$ and glossiness $\lambda$. In FIG. 6, the horizontal axis indicates the overall amount of YMCK-colored ink for printing per unit area A and the vertical axis shows the amount of transparent ink for printing per unit area B.

As shown in FIG. 6, the straight line representing the overall amount of ink for printing A and the amount of ink for printing B goes asymptotic to the straight line shown by the dotted line, with the increase of the glossiness $\lambda$, and to the straight line shown by the solid line, with the decrease of glossiness $\lambda$. Since the $\beta_1$ is a function of the glossiness $\lambda$, the value of $\beta_1$ on the solid line of FIG. 6 and the value of $\beta_1$ on the dotted line are different from each other.

The following describes the operation of the inkjet printer recording apparatus as a second embodiment.

When the control apparatus 15 controls the carriage 4, the carriage 4 travels in the scanning direction x. During the traveling of the carriage 4, the glossiness of the recording medium 99 is measured by the gloss meter 13. The control apparatus 15 inputs the measured glossiness from the gloss meter 13. If the measured glossiness inputted from the gloss meter 13 is less than a predetermined value, the control apparatus 15 selects the first mode. If the measured glossiness inputted from the gloss meter 13 is equal to or greater than the predetermined value, the control apparatus 15 selects the second mode.

When the first mode has been selected, the control apparatus 15 determines the relationship between the overall amount of ink for printing A and the amount of ink for printing B, based on the measured glossiness inputted from the gloss meter 13. The control apparatus 15 substitutes the glossiness measured by the gloss meter 13, into the glossiness $\lambda$ of the relationship between the glossiness $\lambda$ and $\alpha_1$ stored in the ROM, and obtains the value of $\alpha_1$. At the same time, the control apparatus 15 substitutes the glossiness measured by the gloss meter 13, into the relationship between glossiness $\lambda$ and $\beta_1$ stored in the ROM with respect to the glossiness $\lambda$, and obtains the value of $\beta_1$. From the obtained $\alpha_1$ and $\beta_1$, the control apparatus 15 determines the relationship (Eq. (1)) between the overall amount of ink for printing A and the amount of ink for printing B. When the control apparatus 15 has turned on the ultraviolet irradiation apparatuses 10 and 11 and controls the conveyance apparatus 14, the conveyance apparatus 14 repeats the convey/stop operation of the recording medium 99 so that the recording medium 99 is conveyed on an intermittent basis. If the control apparatus 15 controls the carriage 4 during the conveyance of the recording medium 99, the carriage 4 performs a reciprocating motion in the scanning direction x when the recording medium 99 is stopped. Further, if the control apparatus 15 controls the recording heads 5 through 9 based on the inputted gradation value during the reciprocating motion of the carriage 4, then the recording heads 5 through 9 emits ink particles from the outlet to the recording medium 99 as required. The ink having reached the recording medium 99 is cured when exposed to the ultraviolet rays emitted from the ultraviolet irradiation apparatuses 10 and 11. Through the repetition of this procedure, an image is formed on the recording medium 99. When an image is recorded on the recording medium 99, the control apparatus 15 determines the overall amount of colored ink for printing per unit area emitted from the recording heads 5 through 8, in conformity to the image data having been inputted from the outside. After that, based on the relationship between the overall amount of ink for printing A and the amount of ink for printing B, it determines the amount of ink for printing per unit area emitted from the transparent ink recording head 9, from the overall amount of colored ink for printing having been determined. Then the recording heads 5 through 8 are allowed to emit the colored ink in the determined overall amount of ink for printing. At the same time, the transparent ink recording head 9 is allowed to emit the transparent ink in the determined overall amount of ink for printing.

When the second mode has been selected, the control apparatus 15 provides the same control as that in the second mode of the first embodiment.

Similarly to the case of the first embodiment, an image having uniform glossiness on the inner surface can be recorded on the recording medium 99 in the present embodiment.

Further, if the glossiness of the recording medium 99 is lower than the predetermined value, the relationship shown in FIG. 4 is determined based on the glossiness of the recording medium 99. Consequently, an image having uniform glossiness on the inner surface can be recorded on the recording medium of any glossiness.

[Embodiment 3]

The following describes the third embodiment of the present invention. In the inkjet printer recording apparatus as a third embodiment, the portions corresponding to any portions of the inkjet printer recording apparatus 1 of the first embodiment will be assigned with the same reference numerals, and the same portions will not be described to avoid duplication. In the following description, the same reference numerals will be used to explain the inkjet printer recording apparatus as a third embodiment.

Similarly to the inkjet printer recording apparatus 1 of the first embodiment the inkjet printer recording apparatus of the third embodiment comprises a platen 2, a guide member 3, a carriage 4, recording heads 5 through 9, ultraviolet irradiation apparatuses 10 and 11, a gloss meter 13, a conveyance apparatus 14 and a control apparatus 15.

In the third embodiment, when the first mode is selected and the relationship (as shown in Equation (1)) of the chart in FIG. 4 is used, the control apparatus 15 determines the relationship as shown in the chart of FIG. 4, based on the set value of the maximum overall amount of colored ink for printing per unit area. To be more specific, in the third embodiment, $\alpha_1$ is stored in the ROM as a variable of the maximum overall amount of colored ink for printing $\gamma$ per unit area. More specifically, the horizontal axis indicates the overall amount of YMCK-colored ink for printing per unit area A and the vertical axis shows the amount of transparent ink for printing per unit area B.

Figure 7:
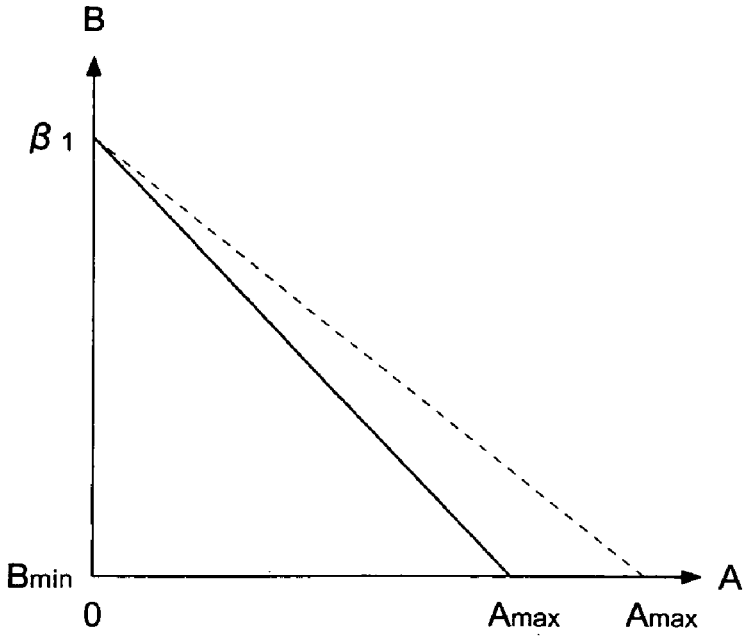
FIG. 7 is a chart representing the relationship between the overall amount of ink for printing A and the amount of ink for printing B.

As shown in FIG. 7, the straight line representing the overall amount of ink for printing A and the amount of ink for printing B goes asymptotic to the straight line shown by the dotted line, with the increase of the maximum overall amount of ink for printing $\gamma$ and to the straight line shown by the solid line, with the decrease of the maximum overall amount of ink for printing $\gamma$. Since the $\alpha_1$ increases and the $\beta_1$ stays constant as the maximum overall amount of ink for printing $\gamma$ increases, the maximum value $A_{max}$ of the overall amount of ink for printing A on the solid line of FIG. 7 and the maximum value $A_{max}$ on the dotted line are different from each other.

The following describes the operation of the inkjet printer recording apparatus as a third embodiment.

When the control apparatus 15 controls the carriage 4, the carriage 4 travels in the scanning direction x. During the traveling of the carriage 4, the glossiness of the recording medium 99 is measured by the gloss meter 13. The control apparatus 15 inputs the measured glossiness from the gloss meter 13. If the measured glossiness inputted from the gloss meter 13 is less than a predetermined value, the control apparatus 15 selects the first mode. If the measured glossiness inputted from the gloss meter 13 is equal to or greater than the predetermined value, the control apparatus 15 selects the second mode.

When the first mode has been selected, the control apparatus 15 determines the relationship between the overall amount of ink for printing A and the amount of ink for printing B, based on the set value of the maximum overall amount of colored ink for printing per unit area. To put it more specifically, the control apparatus 15 substitutes the set value of the maximum overall amount of colored ink for printing per unit area, into the maximum overall amount of ink for printing $\gamma$ of the relationship between the maximum overall amount of ink for printing $\gamma$ and $\alpha_1$ stored in the ROM, and obtains the value of $\alpha_1$. The control apparatus 15 determines the relationship (Equation (1)) between the overall amount of ink for printing A and the amount of ink for printing B, from a constant $\beta_1$ stored in the ROM and the obtained $\alpha_1$. When the control apparatus 15 has turned on the ultraviolet irradiation apparatuses 10 and 11 and controls the conveyance apparatus 14, the conveyance apparatus 14 repeats the convey/stop operation of the recording medium 99 so that the recording medium 99 is conveyed on an intermittent basis. If the control apparatus 15 controls the carriage 4 during the conveyance of the recording medium 99, the carriage 4 performs a reciprocating motion in the scanning direction x when the recording medium 99 is stopped. Further, when the control apparatus 15 controls the recording heads 5 through 9 based on the inputted gradation value during the reciprocating motion of the carriage 4, then the recording heads 5 through 9 emits ink particles from the outlet to the recording medium 99 as required. The ink having reached the recording medium 99 is cured when exposed to the ultraviolet rays emitted from the ultraviolet irradiation apparatuses 10 and 11. Through the repetition of this procedure, an image is formed on the recording medium 99. When an image is recorded on the recording medium 99, the control apparatus 15 determines the overall amount of colored ink for printing per unit area emitted from the recording heads 5 through 8, in conformity to the image data having been inputted from the outside. After that, based on the relationship between the overall amount of ink for printing A and the amount of ink for printing B, it determines the amount of ink for printing per unit area emitted from the transparent ink recording head 9, from the overall amount of colored ink for printing having been determined. Then the recording heads 5 through 8 are allowed to emit the colored ink in the determined overall amount of colored ink for printing. At the same time, the transparent ink recording head 9 is allowed to emit the transparent ink in the determined amount of ink.

In the meantime, when the second mode has been selected, the control apparatus 15 provides the same control as that in the second mode of the first embodiment.

Similarly to the case of the first embodiment, an image having uniform glossiness on the inner surface can be recorded on the recording medium 99 in the present embodiment.

Further, if the glossiness of the recording medium 99 is lower than the predetermined value, the relationship shown in FIG. 4 is determined based on the set value of the maximum amount of ink-for printing. Consequently, an image having uniform glossiness on the inner surface can be recorded on the recording medium even if the maximum amount of colored ink for printing per unit area has been changed.

[Embodiment 4]

The following describes the fourth embodiment of the present invention. In the inkjet printer recording apparatus as a fourth embodiment, the portions corresponding to any portions of the inkjet printer recording apparatus 1 of the first embodiment will be assigned with the same reference numerals, and the same portions will not be described to avoid duplication. In the following description, the same reference numerals will be used to explain the inkjet printer recording apparatus as a fourth embodiment.

Similarly to the inkjet printer recording apparatus 1 of the first embodiment the inkjet printer recording apparatus of the fourth embodiment comprises a platen 2, a guide member 3, a carriage 4, recording heads 5 through 9, ultraviolet irradiation apparatuses 10 and 11, a gloss meter 13, a conveyance apparatus 14 and a control apparatus 15.

Figure 8:
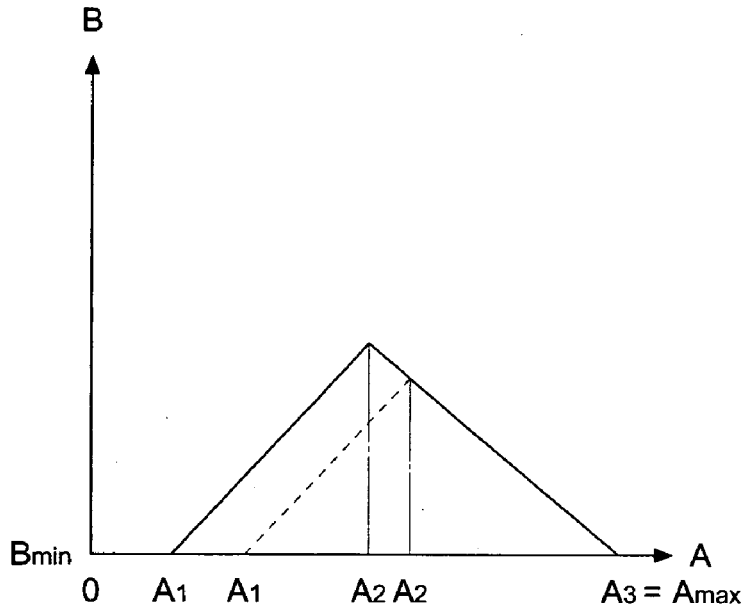
FIG. 8 is a chart representing the relationship between the overall amount of ink for printing A and the amount of ink for printing B.

In the fourth embodiment, when the second mode is selected and the relationship (as shown in Equation (2)) of the chart in FIG. 5 is used, the control apparatus 15 determines the relationship as shown in the chart of FIG. 5, based on the glossiness measured by the gloss meter 13. To be more specific, in the fourth embodiment, $\beta_2$ is stored in the ROM as a variable of the glossiness $\lambda$. More specifically, the ROM stores the relationship wherein the $\beta_2$ decreases as the glossiness $\lambda$ increases. The $\alpha_2$, $\alpha_3$ and $\beta_3$ are stored in the ROM as constants; accordingly, the boundary condition also depends on glossiness $\lambda$. To be more specific, the $\alpha_2$, $\alpha_3$ and $\beta_3$ are constant, and the $\beta_2$ decreases as the glossiness $\lambda$ increases; therefore, the first threshold value $A_1$ increases as the glossiness $\lambda$ increases; further, the second threshold value $A_2$ also increase. The third threshold value $A_3$ stays constant, independently of the value of the glossiness $\lambda$. Based on such a relationship between $\beta$ and glossiness $\lambda$, the relationship between the overall amount of ink for printing A and the amount of ink for printing B is graphically represented in FIG. 8. In FIG. 8, the horizontal axis indicates the overall amount of YMCK-colored ink for printing per unit area A and the vertical axis shows the amount of transparent ink for printing per unit area B.

As shown in FIG. 8, the straight line representing the overall amount of ink for printing A and the amount of ink for printing B goes asymptotic to the polygonal line shown by the dotted line, with the increase of the glossiness $\lambda$, and to the polygonal line shown by the solid line, with the decrease of glossiness $\lambda$.

The following describes the operation of the inkjet printer recording apparatus as a fourth embodiment.

When the control apparatus 15 controls the carriage 4, the carriage 4 travels in the scanning direction x. During the traveling of the carriage 4, the glossiness of the recording medium 99 is measured by the gloss meter 13. The control apparatus 15 inputs the measured glossiness from the gloss meter 13. If the measured glossiness inputted from the gloss meter 13 is less than a predetermined value, the control apparatus 15 selects the first mode. If the measured glossiness inputted from the gloss meter 13 is equal to or greater than the predetermined value, the control apparatus 15 selects the second mode.

When the second mode has been selected, the control apparatus 15 determines the relationship between the overall amount of ink for printing A and the amount of ink for printing B, based on the measured glossiness inputted from the gloss meter 13. To put it more specifically, the control apparatus 15 substitutes the glossiness measured by the gloss meter 13, into the glossiness $\lambda$ of the relationship between the glossiness $\lambda$ and $\beta_2$ stored in the ROM, and obtains the value of $\beta_2$. The control apparatus 15 determines the relationship (Eq. (2)) between the overall amount of ink for printing A and the amount of ink for printing B, from the $\alpha_2$, $\alpha_3$ and $\beta_3$ stored in the ROM and the obtained $\beta_2$. When the control apparatus 15 has turned on the ultraviolet irradiation apparatuses 10 and 11 and controls the conveyance apparatus 14, the conveyance apparatus 14 repeats the convey/stop operation of the recording medium 99 so that the recording medium 99 is conveyed on an intermittent basis. If the control apparatus 15 controls the carriage 4 during the conveyance of the recording medium 99, the carriage 4 performs a reciprocating motion in the scanning direction x when the recording medium 99 is stopped. Further, if the control apparatus 15 controls the recording heads 5 through 9 based on the inputted gradation value during the reciprocating motion of the carriage 4, then the recording heads 5 through 9 emits ink particles from the outlet to the recording medium 99 as required. The ink having reached the recording medium 99 is cured when exposed to the ultraviolet rays emitted from the ultraviolet irradiation apparatuses 10 and 11. Through the repetition of this procedure, an image is formed on the recording medium 99. When an image is recorded on the recording medium 99, the control apparatus 15 determines the overall amount of colored ink for printing per unit area emitted from the recording heads 5 through 8, in conformity to the image data having been inputted from the outside. After that, based on the relationship between the overall amount of ink for printing A and the amount of ink for printing B, it determines the amount of ink for printing per unit area emitted from the transparent ink recording head 9, from the overall amount of colored ink for printing having been determined. Then the recording heads 5 through 8 are allowed to emit the colored ink in the determined overall amount of ink for printing. At the same time, the transparent ink recording head 9 is allowed to emit the transparent ink in the determined overall amount of ink for printing.

When the first mode has been selected, the control apparatus 15 provides the same control as that in the first mode of the first embodiment.

Similarly to the case of the first embodiment, an image having uniform glossiness on the inner surface can be recorded on the recording medium 99 in the present embodiment.

Further, if the glossiness of the recording medium 99 is equal to or greater than the predetermined value, the relationship shown in FIG. 5 is determined based on the glossiness of the recording medium 99. Consequently, an image having uniform glossiness on the inner surface can be recorded on the recording medium of any glossiness.

[Embodiment 5]

The following describes the fifth embodiment of the present invention. In the inkjet printer recording apparatus as a fifth embodiment, the portions corresponding to any portions of the inkjet printer recording apparatus 1 of the first embodiment will be assigned with the same reference numerals, and the same portions will not be described to avoid duplication. In the following description, the same reference numerals will be used to explain the inkjet printer recording apparatus as a fifth embodiment.

Similarly to the inkjet printer recording, apparatus 1 of the first embodiment the inkjet printer recording apparatus of the fifth embodiment comprises a platen 2, a guide member 3, a carriage 4, recording heads 5 through 9, ultraviolet irradiation apparatuses 10 and 11, a gloss meter 13, a conveyance apparatus 14 and a control apparatus 15.

Figure 9:
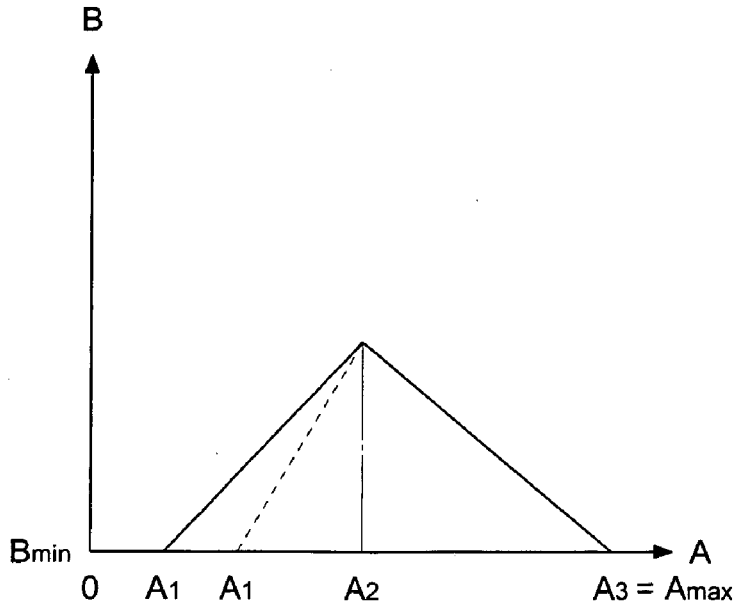
FIG. 9 is a chart representing the relationship between the overall amount of ink for printing A and the amount of ink for printing B.

In the fifth embodiment, when the second mode is selected and the relationship (as shown in Equation (2)) of the chart in FIG. 5 is used, the control apparatus 15 determines the relationship as shown in the chart of FIG. 5, based on the glossiness measured by the gloss meter 13. To be more specific, in the fifth embodiment, the $\alpha_2$ and $\beta_2$ are stored in the ROM as a variable of the glossiness $\lambda$. More specifically, the ROM stores the relationship wherein the $\beta_2$ decreases as the glossiness $\lambda$ increases, and the relationship wherein the $\alpha_2$ increases as the glossiness $\lambda$ increases. The $\alpha_3$ and $\beta_3$ are stored in the ROM as constants; accordingly, the boundary condition also depends on glossiness $\lambda$. To be more specific, the $\alpha_3$ and $\beta_3$ are constant, and the $\beta_2$ decreases as the glossiness $\lambda$ increases; therefore, the first threshold value $A_1$ increases as the glossiness $\lambda$ increases. Independently of the value of glossiness $\lambda$, the second threshold value $A_2$ and the third threshold value $A_3$ are constant. Based on such a relationship between the $\alpha_2$, $\beta_2$ and glossiness $\lambda$, the relationship between the overall amount of ink for printing A and the amount of ink for printing B is graphically represented in FIG. 9. In FIG. 9, the horizontal axis indicates the overall amount of YMCK-colored ink for printing per unit area A and the vertical axis shows the amount of transparent ink for printing per unit area B.

As shown in FIG. 9, the line representing the overall amount of ink for printing A and the amount of ink for printing B goes asymptotic to the polygonal line shown by the dotted line, with the increase of the glossiness $\lambda$, and to the polygonal line shown by the solid line, with the decrease of glossiness $\lambda$.

The following describes the operation of the inkjet printer recording apparatus as a fifth embodiment.

When the control apparatus 15 controls the carriage 4, the carriage 4 travels in the scanning direction x. During the traveling of the carriage 4, the glossiness of the recording medium 99 is measured by the gloss meter 13. The control apparatus 15 inputs the measured glossiness from the gloss meter 13. If the measured glossiness inputted from the gloss meter 13 is less than a predetermined value, the control apparatus 15 selects the first mode. If the measured glossiness inputted from the gloss meter 13 is equal to or greater than the predetermined value, the control apparatus 15 selects the second mode.

When the second mode has been selected, the control apparatus 15 determines the relationship between the overall amount of ink for printing A and the amount of ink for printing B, based on the measured glossiness inputted from the gloss meter 13. To put it more specifically, the control apparatus 15 substitutes the glossiness measured by the gloss meter 13, into the glossiness $\lambda$ of the relationship between the glossiness $\lambda$ and $\beta_2$ stored in the ROM, and obtains the value of $\alpha_2$, and substitutes the glossiness measured by the gloss meter 13, into the glossiness $\lambda$ of the relationship between the glossiness $\lambda$ and $\beta_2$ stored in the ROM, and obtains the value of $\beta_2$. The control apparatus 15 determines the relationship (Eq. (2)) between the overall amount of ink for printing A and the amount of ink for printing B, from the $\alpha_3$ and $\beta_3$ stored in the ROM and the obtained $\alpha_2$ and $\beta_2$. When the control apparatus 15 has turned on the ultraviolet irradiation apparatuses 10 and 11 and controls the conveyance apparatus 14, the conveyance apparatus 14 repeats the convey/stop operation of the recording medium 99 so that the recording medium 99 is conveyed on an intermittent basis. If the control apparatus 15 controls the carriage 4 during the conveyance of the recording medium 99, the carriage 4 performs a reciprocating motion in the scanning direction x when the recording medium 99 is stopped. Further, if the control apparatus 15 controls the recording heads 5 through 9 based on the inputted gradation value during the reciprocating motion of the carriage 4, then the recording heads 5 through 9 emits ink particles from the outlet to the recording medium 99 as required. The ink having reached the recording medium 99 is cured when exposed to the ultraviolet rays emitted from the ultraviolet irradiation apparatuses 10 and 11. Through the repetition of this procedure, an image is formed on the recording medium 99. When an image is recorded on the recording medium 99, the control apparatus 15 determines the overall amount of colored ink for printing per unit area emitted from the recording heads 5 through 8, in conformity to the image data having been inputted from the outside. After that, based on the relationship between the overall amount of ink for printing A and the amount of ink for printing B, it determines the amount of ink for printing per unit area emitted from the transparent ink recording head 9, from the overall amount of colored ink for printing having been determined. Then the recording heads 5 through 8 are allowed to emit the colored ink in the determined overall amount of ink for printing. At the same time, the transparent ink recording head 9 is allowed to emit the transparent ink in the determined overall amount of ink for printing.

When the first mode has been selected, the control apparatus 15 provides the same control as that in the first mode of the first embodiment.

Similarly to the case of the first embodiment, an image having uniform glossiness on the inner surface can be recorded on the recording medium 99 in the present embodiment.

Further, if the glossiness of the recording medium 99 is equal to or greater than the predetermined value, the relationship shown in FIG. 5 is determined based on the glossiness of the recording medium 99. Consequently, an image having uniform glossiness on the inner surface can be recorded on the recording medium of any glossiness.

[Embodiment 6]

The following describes the sixth embodiment of the present invention. In the inkjet printer recording apparatus as a sixth embodiment, the portions corresponding to any portions of the inkjet printer recording apparatus 1 of the first embodiment will be assigned with the same reference numerals, and the same portions will not be described to avoid duplication. In the following description, the same reference numerals will be used to explain the inkjet printer recording apparatus as a sixth embodiment.

Similarly to the inkjet printer recording apparatus 1 of the first embodiment the inkjet printer recording apparatus of the sixth embodiment comprises a platen 2, a guide member 3, a carriage 4, recording heads 5 through 9, ultraviolet irradiation apparatuses 10 and 11, a gloss meter 13, a conveyance apparatus 14 and a control apparatus 15.

Figure 10:
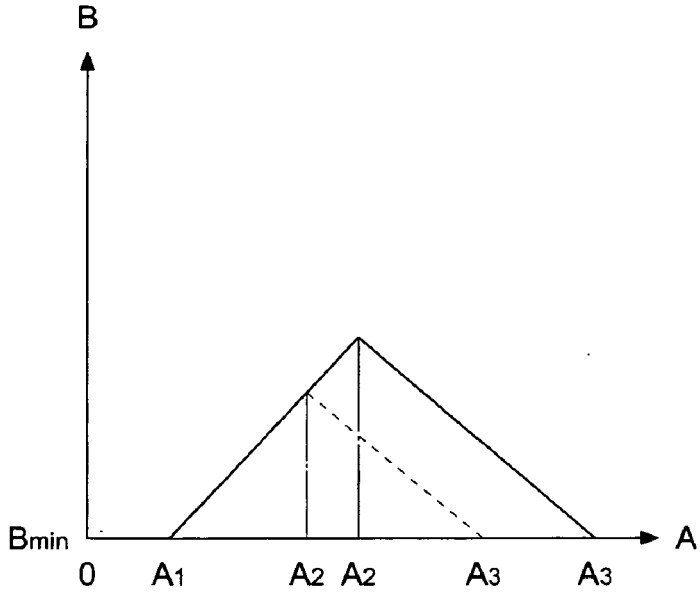
FIG. 10 is a chart representing the relationship between the overall amount of ink for printing A and the amount of ink for printing B.

In the sixth embodiment, when the second mode is selected and the relationship (as shown in Equation (2)) of the chart in FIG. 5 is used, the control apparatus 15 determines the relationship as shown in the chart of FIG. 5, based on the set value of the maximum overall amount of colored ink for printing per unit area. To put it more specifically, in the sixth embodiment, the $\beta_3$ is stored in the ROM as a variable of the maximum overall amount of colored ink for printing per unit area $\gamma$. More specifically, the ROM stores the relationship wherein the $\beta_3$ decreases as the maximum overall amount of ink for printing $\gamma$ increases. The $\alpha_2$, $\beta_2$ and $\alpha_3$ are stored in the ROM as constants; accordingly, the boundary condition also depends on the maximum overall amount of ink for printing $\gamma$. To be more specific, $\alpha_2$, $\beta_2$ and $\alpha_3$ are constant, and the $\beta_3$ decreases as the maximum overall amount of ink for printing $\gamma$ increases; therefore, the third threshold value $A_3$ increases as the second threshold value $A_2$ increases. Independently of the value of the maximum overall amount of ink for printing $\gamma$, the first threshold value $A_1$ is constant. Based on such a relationship between the $\beta_3$ and the maximum overall amount of ink for printing $\gamma$, the relationship between the overall amount of ink for printing A and the amount of ink for printing B is graphically represented in FIG. 10. In FIG. 10, the horizontal axis indicates the overall amount of YMCK-colored ink for printing per unit area A and the vertical axis shows the amount of transparent ink for printing per unit area B.

As shown in FIG. 10, the line representing the overall amount of ink for printing A and the amount of ink for printing B goes asymptotic to the polygonal line shown by the dotted line, with the increase of the maximum overall amount of ink for printing $\gamma$, and to the polygonal line shown by the solid line, with the decrease of the maximum overall amount of ink for printing $\gamma$.

The following describes the operation of the inkjet printer recording apparatus as a sixth embodiment.

When the control apparatus 15 controls the carriage 4, the carriage 4 travels in the scanning direction x. During the traveling of the carriage 4, the glossiness of the recording medium 99 is measured by the gloss meter 13. The control apparatus 15 inputs the measured glossiness from the gloss meter 13. If the measured glossiness inputted from the gloss meter 13 is less than a predetermined value, the control apparatus 15 selects the first mode. If the measured glossiness inputted from the gloss meter 13 is equal to or greater than the predetermined value, the control apparatus 15 selects the second mode.

When the second mode has been selected, the control apparatus 15 determines the relationship between the overall amount of ink for printing A and the amount of ink for printing B, based on the set value of the maximum overall amount of colored ink for printing per unit area. To put it more specifically, the control apparatus 15 substitutes the set value of the maximum overall amount of colored ink for printing per unit area, into the maximum overall amount of ink for printing $\gamma$ of the relationship between the maximum overall amount of ink for printing $\gamma$ and $\beta_3$ stored in the ROM, and obtains the value of $\beta_3$. The control apparatus 15 determines the relationship (Eq. (2)) between the overall amount of ink for printing A and the amount of ink for printing B, from constant $\alpha_2$, $\beta_2$ and $\alpha_3$ stored in the ROM and the obtained $\beta_3$. When the control apparatus 15 has turned on the ultraviolet irradiation apparatuses 10 and 11 and controls the conveyance apparatus 14, the conveyance apparatus 14 repeats the convey/stop operation of the recording medium 99 so that the recording medium 99 is conveyed on an intermittent basis. If the control apparatus 15 controls the carriage 4 during the conveyance of the recording medium 99, the carriage 4 performs a reciprocating motion in the scanning direction x when the recording medium 99 is stopped. Further, when the control apparatus 15 controls the recording heads 5 through 9 based on the inputted gradation value during the reciprocating motion of the carriage 4, then the recording heads 5 through 9 emits ink particles from the outlet to the recording medium 99 as required. The ink having reached the recording medium 99 is cured when exposed to the ultraviolet rays emitted from the ultraviolet irradiation apparatuses 10 and 11. Through the repetition of this procedure, an image is formed on the recording medium 99. When an image is recorded on the recording medium 99, the control apparatus 15 determines the overall amount of colored ink for printing per unit area emitted from the recording heads 5 through 8, in conformity to the image data having been inputted the outside. After that, based on the relationship between the overall amount of ink for printing A and the amount of ink for printing B, it determines the amount of ink for printing per unit area emitted from the transparent ink recording head 9, from the overall amount of colored ink for printing having been determined. Then the recording heads 5 through 8 is allowed to emit the colored ink in the determined overall amount of colored ink for printing. At the same time, the transparent ink recording head 9 is allowed to emit the transparent ink in the determined amount of ink.

In the meantime, when the first mode has been selected, the control apparatus 15 provides the same control as that in the first mode of the first embodiment.

Similarly to the case of the first embodiment, an image having uniform glossiness on the inner surface can be recorded on the recording medium 99 in the present embodiment.

Further, if the glossiness of the recording medium 99 is equal to or greater than the predetermined value, the relationship shown in the chart of FIG. 5 is determined based on the set value of the maximum amount of ink for printing. Consequently, an image having uniform glossiness on the inner surface can be recorded on the recording medium even if the maximum amount of colored ink for printing per unit area has been changed.

[Embodiment 7]

The following describes the seventh embodiment of the present invention. In the inkjet printer recording apparatus as a seventh embodiment, the portions corresponding to any portions of the inkjet printer recording apparatus 1 of the first embodiment will be assigned with the same reference numerals, and the same portions will not be described to avoid duplication. In the following description, the same reference numerals will be used to explain the inkjet printer recording apparatus as a seventh embodiment.

Similarly to the inkjet printer recording apparatus 1 of the first embodiment the inkjet printer recording apparatus of the seventh embodiment comprises a platen 2, a guide member 3, a carriage 4, recording heads 5 through 9, ultraviolet irradiation apparatuses 10 and 11, a gloss meter 13, a conveyance apparatus 14 and a control apparatus 15.

Figure 11:
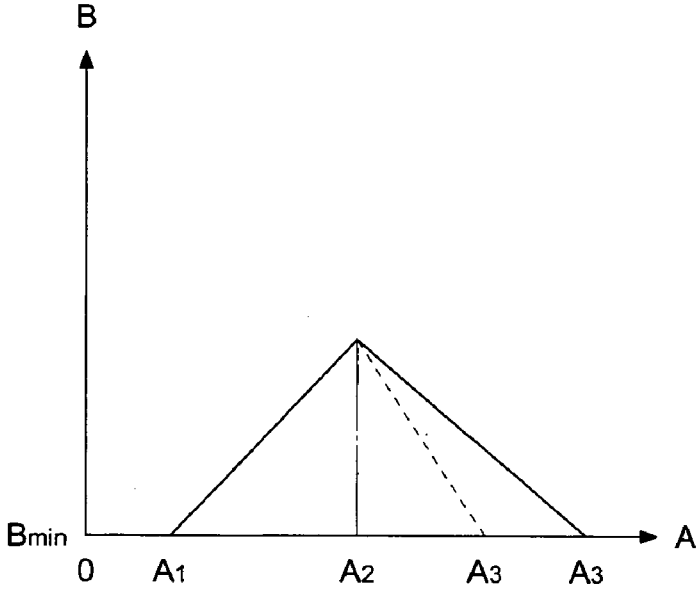
FIG. 11 is a chart representing the relationship between the overall amount of ink for printing A and the amount of ink for printing B.

In the seventh embodiment, when the second mode is selected and the relationship (as shown in Equation (2)) of the chart in FIG. 5 is used, the control apparatus 15 determines the relationship as shown in the chart of FIG. 5, based on the set value of the maximum overall amount of colored ink for printing per unit area. To put it more specifically, in the seventh embodiment, the $\alpha_3$ is stored in the ROM as a variable of the maximum overall amount of colored ink for printing per unit area $\gamma$. The $\beta_3$ is also stored in the ROM as a variable of the maximum overall amount of colored ink for printing per unit area $\gamma$. More specifically, the ROM stores the relationship wherein the $\beta_3$ decreases as the maximum overall amount of ink for printing $\gamma$ increases. The $\alpha_2$ and $\beta_2$ are stored in the ROM as constants; accordingly, the boundary condition also depends on the maximum overall amount of ink for printing $\gamma$. To be more specific, $\alpha_2$ and $\beta_2$ are constant, and the $\alpha_3$ increases as the maximum overall amount of ink for printing $\gamma$ increases while the $\beta_3$ decreases as the maximum overall amount of ink for printing $\gamma$ increases; therefore, the third threshold value $A_3$ increases as the maximum overall amount of ink for printing $\gamma$ increases. Independently of the value of the maximum overall amount of ink for printing $\gamma$, the first threshold value $A_1$ and the second threshold value $A_2$ are constant. Based on such a relationship between the $\alpha_3$, $\beta_3$ and the maximum overall amount of ink for printing $\gamma$, the relationship between the overall amount of ink for printing A and the amount of ink for printing B is graphically represented in FIG. 11. In FIG. 11, the horizontal axis indicates the overall amount of YMCK-colored ink for printing per unit area A and the vertical axis shows the amount of transparent ink for printing per unit area B.

As shown in FIG. 11, the line representing the relationship between the overall amount of ink for printing A and the amount of ink for printing B goes asymptotic to the polygonal line shown by the solid line, with the increase of the maximum overall amount of ink for printing $\gamma$, and to the polygonal line shown by the dotted line, with the decrease of the maximum overall amount of ink for printing $\gamma$.

The following describes the operation of the inkjet printer recording apparatus as a seventh embodiment.

When the control apparatus 15 controls the carriage 4, the carriage 4 travels in the scanning direction x. During the traveling of the carriage 4, the glossiness of the recording medium 99 is measured by the gloss meter 13. The control apparatus 15 inputs the measured glossiness from the gloss meter 13. If the measured glossiness inputted from the gloss meter 13 is less than a predetermined value, the control apparatus 15 selects the first mode. If the measured glossiness inputted from the gloss meter 13 is equal to or greater than the predetermined value, the control apparatus 15 selects the second mode.

When the second mode has been selected, the control apparatus 15 determines the relationship between the overall amount of ink for printing A and the amount of ink for printing B, based on the set value of the maximum overall amount of colored ink for printing per unit area. To put it more specifically, the control apparatus 15 substitutes the set value of the maximum overall amount of colored ink for printing per unit area, into the maximum overall amount of ink for printing $\gamma$ of the relationship between the maximum overall amount of ink for printing $\gamma$ and $\alpha_3$ stored in the ROM, and obtains the value of $\alpha_3$. It also substitutes the set value of the maximum overall amount of colored ink for printing per unit area, into the maximum overall amount of ink for printing $\gamma$ of the relationship between the maximum overall amount of ink for printing $\gamma$ and $\beta_3$ stored in the ROM, and obtains the value of $\beta_3$. The control apparatus 15 determines the relationship (Eq. (2)) between the overall amount of ink for printing A and the amount of ink for printing B, from the constant $\alpha_2$ and $\beta_2$ stored in the ROM and the obtained $\alpha_3$ and $\beta_3$. When the control apparatus 15 has turned on the ultraviolet irradiation apparatuses 10 and 11 and controls the conveyance apparatus 14, the conveyance apparatus 14 repeats the convey/stop operation of the recording medium 99 so that the recording medium 99 is conveyed on an intermittent basis. If the control apparatus 15 controls the carriage 4 during the conveyance of the recording medium 99, the carriage 4 performs a reciprocating motion in the scanning direction x when the recording medium 99 is stopped. Further, when the control apparatus 15 controls the recording heads 5 through 9 based on the inputted gradation value during the reciprocating motion of the carriage 4, then the recording heads 5 through 9 emits ink particles from the outlet to the recording medium 99 as required. The ink having reached the recording medium 99 is cured when exposed to the ultraviolet rays emitted from the ultraviolet irradiation apparatuses 10 and 11. Through the repetition of this procedure, an image is formed on the recording medium 99. When an image is recorded on the recording medium 99, the control apparatus 15 determines the overall amount of colored ink for printing per unit area emitted from the recording heads 5 through 8, in conformity to the image data having been inputted from the outside. After that, based on the relationship between the overall amount of ink for printing A and the amount of ink for printing B, it determines the amount of ink for printing per unit area emitted from the transparent ink recording head 9, from the overall amount of colored ink for printing having been determined. Then the recording heads 5 through 8 is allowed to emit the colored ink in the determined overall amount of colored ink for printing. At the same time, the transparent ink recording head 9 is allowed to emit the transparent ink in the determined amount of ink.

In the meantime, when the first mode has been selected, the control apparatus 15 provides the same control as that in the first mode of the first embodiment.

Similarly to the case of the first embodiment, an image having uniform glossiness on the inner surface can be recorded on the recording medium 99 in the present embodiment.

Further, if the glossiness of the recording medium 99 is equal to or greater than the predetermined value, the relationship shown in the chart of FIG. 5 is determined based on the set value of the maximum amount of ink for printing. Consequently, an image having uniform glossiness on the inner surface can be recorded on the recording medium even if the maximum amount of colored ink for printing per unit area has been changed.

EXAMPLE OF VARIATION

It is to be expressly understood, however, that the present invention is not restricted to the embodiments described above. The present invention can be embodied in a great number of variations with appropriate modification or design changes, without departing from the technological spirit and scope of the invention claimed.

In the aforementioned embodiments of the present invention, reference is made to an example where the inkjet printer recording apparatus of the present invention is applied to a serial type inkjet printer recording apparatus. The inkjet printer recording apparatus of the present invention can also be to a line head type inkjet printer recording apparatus.

Figure 12:
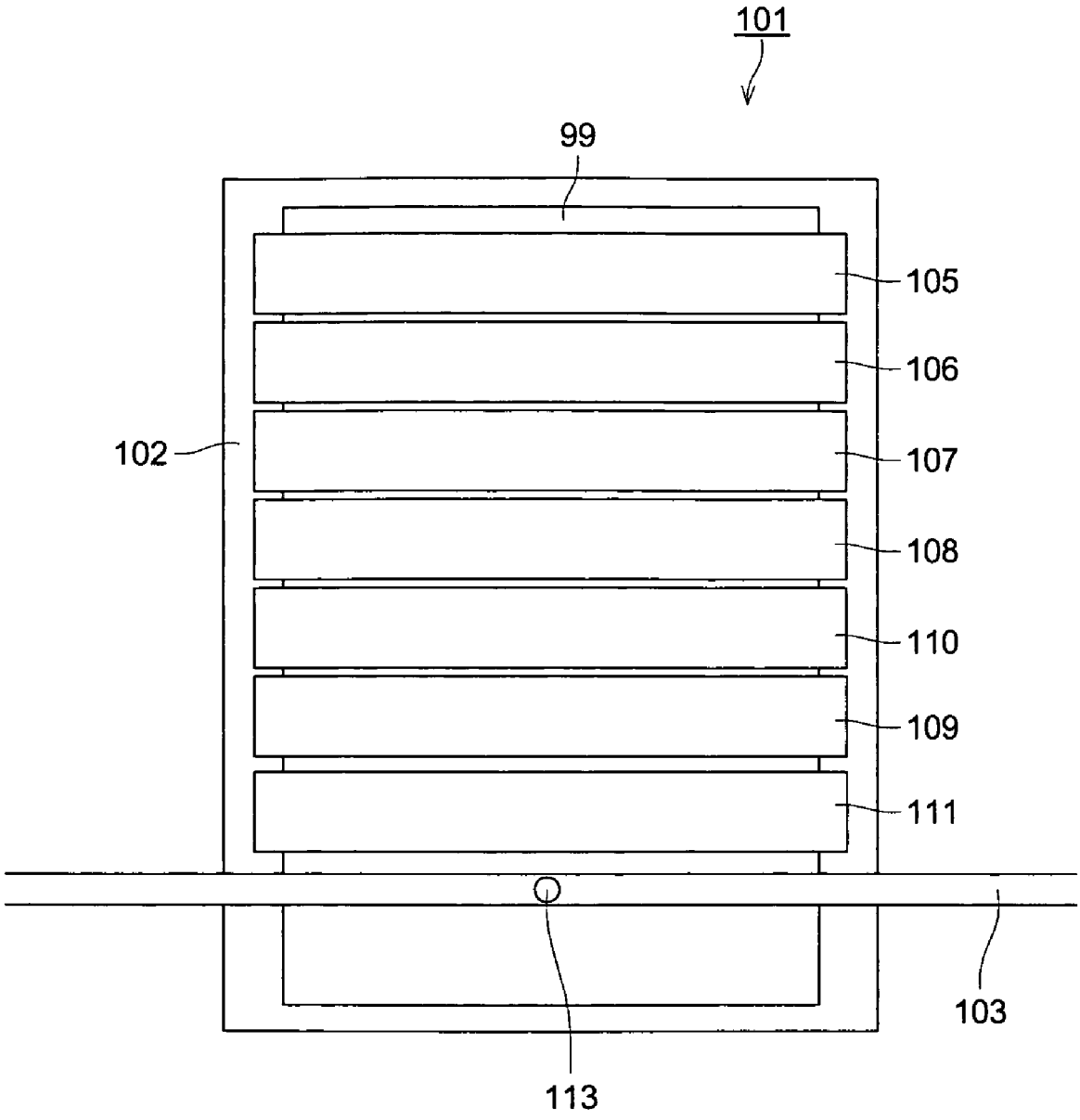
FIG. 12 is a plan view of an inkjet printer recording apparatus 101.

FIG. 12 shows a line head type inkjet printer recording apparatus 101. This inkjet printer recording apparatus 101 comprises:

a platen 102 formed in a flat plate, a guide member 103, above the platen 102, arranged parallel to the platen 102, a conveyance apparatus for conveying a recording medium 99 in the conveyance direction y orthogonal to the extended direction of the guide member 103, a gloss meter 113 supported by the guide member 103 and arranged movably along the guide member 103, line type recording heads 105 through 109 arranged above the platen 102 so as to extend across the recording medium 99, viz., in the direction orthogonal to the conveyance direction y of the recording medium 99;

an ultraviolet irradiation apparatus 110 arranged downstream from the line type recording head 108, and an ultraviolet irradiation apparatus 111 arranged downstream from the line type recording head 109.

The recording heads 105 through 109 are arranged in the conveyance direction y in the order of recording head 105, recording head 106, recording head 107, recording head 108 and recording head 109. The recording heads 105 through 109 are designed emit the particles of the ink that is cured by exposure to ultraviolet rays. The recording head 105 emits the yellow (Y) ink, the recording head 106 the ink containing coloring agent of magenta (M), the recording head 107 containing coloring agent of cyan (C), and the recording head 108 containing coloring agent of black (K). The recording head 109 is a transparent ink recording medium for emitting the transparent ink containing no coloring agent.

The ultraviolet irradiation apparatuses 110 and 111 apply the light containing that of the ultraviolet range to the recording medium 99. The ultraviolet irradiation apparatuses 110 and 111 extend in the direction orthogonal to the conveyance direction y of the recording medium 99 (i.e. direction parallel to the longitudinal direction of the recording head 105).

Similarly to the case of the gloss meter 13, the gloss meter 113 measures glossiness of the recording medium 99 in conformity to JIS Z8741.

This inkjet printer recording apparatus 101 is provided with a control apparatus for providing the same control as that of the control apparatus 15 of the present embodiment. To be more specific, the control apparatus selects either the first or second mode, based on the glossiness measured by the gloss meter 113. When the second mode has been selected, the control apparatus determines the overall amount of colored ink for printing per unit area emitted from the recording heads 105 through 108 according to the image data inputted from the outside. After that, it reads the relationship between the overall amount of ink for printing A and the amount of ink for printing B shown in FIG. 4, from the ROM, and determines the amount of transparent ink for printing per unit area emitted from the transparent ink recording head 109 in conformity to that relationship, based on the overall amount of colored ink for printing having been determined. Then the recording heads 105 through 108 is allowed to emit the colored ink in the determined overall amount of ink for printing. At the same time, the transparent ink recording head 109 is allowed to emit the transparent ink in the determined overall amount of ink for printing. In the meantime, when the second mode has been selected, this control apparatus determines the overall amount of colored ink for printing per unit area emitted from the recording heads 105 through 108, in conformity to the image data having been inputted from the outside. After that, it reads the relationship between the overall amount of ink for printing A and the amount of ink for printing B shown in FIG. 5, from the ROM, and determines the amount of transparent ink for printing per unit area emitted from the transparent ink recording head 109 in conformity to that relationship, based on the overall amount of colored ink for printing having been determined. Then the recording heads 105 through 108 are allowed to emit the colored ink in the determined overall amount of ink for printing. At the same time, the transparent ink recording head 109 is allowed to emit the transparent ink in the determined overall amount of ink for printing.

Similarly to the case the control apparatus 15 as the second embodiment, when the first mode is selected and the relationship shown in the chart of FIG. 4 is used, the control apparatus of the inkjet printer recording apparatus 101 can determine the relationship as shown in the chart of FIG. 4, based on the glossiness measured by the gloss meter 113.

Further, similarly to the case the control apparatus 15 as the third embodiment, when the first mode is selected and the relationship shown in the chart of FIG. 4 is used, the control apparatus 15 of the inkjet printer recording apparatus 101 can determine the relationship as shown in the chart of FIG. 4, based on the set value of the maximum overall amount of colored ink for printing per unit area.

Further, similarly to the case the control apparatus 15 as the fourth or fifth embodiment, when the second mode is selected and the relationship shown in the chart of FIG. 5 is used, the control apparatus of the inkjet printer recording apparatus 101 can determine the relationship as shown in the chart of FIG. 5, based on the glossiness measured by the gloss meter 113.

Further, similarly to the case the control apparatus 15 as the sixth or seventh embodiment, when the second mode is selected and the relationship shown in the chart of FIG. 5 is used, the control apparatus 15 of the inkjet printer recording apparatus 101 can determine the relationship as shown in the chart of FIG. 5, based on the set value of the maximum overall amount of colored ink for printing per unit area.

In the first through seventh embodiments, the control apparatus 15 controls the conveyance apparatus 14 in such a way that the recording medium 99 is conveyed on an intermittent basis. By contrast, the inkjet printer recording apparatus 101 controls the conveyance apparatus in such a way that the recording medium 99 is conveyed on a continuous basis. In the inkjet printer recording apparatus 101, the gloss meter 113 travels along the guide member 103 under the control of the control apparatus. Unlike the first through seventh embodiments, the inkjet printer recording apparatus 101 does not provide such control as to move the carriage 114.

What is claimed is:

1. An inkjet recording apparatus comprising:

a colored ink recording head for emitting photocurable colored ink to a surface of a recording medium;

a transparent ink recording head for emitting transparent ink to the surface of the recording medium;

a control device for controlling the colored ink recording head and the transparent ink recording head; and a gloss measuring device for measuring a glossiness of the surface of the recording medium, wherein the control device controls an amount of ink for printing per unit area on the surface of the recording medium in accordance with a relationship between an amount A of colored ink for printing per unit area and an amount B of transparent ink for printing per unit area, and decides the relationship based on a result measured by the gloss measuring device, so as to make the glossiness of the surface of the recording medium uniform, such that:

when the amount A of colored ink for printing for a unit of area is zero, the control device controls the transparent ink recording head such that the amount B of transparent ink for the unit of area is a predetermined amount of transparent ink; and when the amount A of colored ink for printing for a unit of area is not zero, the control device controls the transparent ink recording head to decrease the amount B of transparent ink for the unit of area in accordance with an increase in the amount A of colored ink.

2. An inkjet recording apparatus comprising:

a colored ink recording head for emitting photocurable colored ink to a surface of a recording medium;

a transparent ink recording head for emitting transparent ink to the surface of the recording medium; and a control device for controlling the colored ink recording head and the transparent ink recording head;

wherein the control device controls an amount of ink for printing per unit area on the surface of the recording medium in accordance with a relationship between an amount A of colored ink for printing per unit area and an amount B of transparent ink for printing per unit area, and the control device decides the relationship based on a maximum overall amount of ink for printing per unit area emitted by the colored ink recording head, so as to make a glossiness of the surface of the recording medium uniform, such that:

when the amount A of colored ink for printing for a unit of area is zero, the control device controls the transparent ink recording head such that the amount B of transparent ink for the unit of area is a predetermined amount of transparent ink; and when the amount A of colored ink for printing for a unit of area is not zero, the control device controls the transparent ink recording head to decrease the amount B of transparent ink for the unit of area in accordance with an increase in the amount A of colored ink.

3. An inkjet recording apparatus comprising:

a colored ink recording head for emitting photocurable colored ink to a recording medium;

a transparent ink recording head for emitting transparent ink to the recording medium; and a control device for controlling the colored ink recording head and transparent ink recording head, wherein the control device controls an amount of ink for printing per unit area emitted by the transparent ink recording head according to a relationship between an amount A of colored ink for printing per unit area and an amount B of transparent ink for printing per unit area, such that:

when the amount A is equal to or greater than a first threshold value $A_1$ and is equal to or smaller than a second threshold value $A_2$, the amount B is increased by an increase in the amount A; and when the amount A is equal to or greater than the second threshold value $A_2$ and is equal to or smaller than a third threshold value $A_3$, the amount B is decreased by an increase in the amount A.

4. The inkjet recording apparatus of claim 3 further comprising:

a gloss measuring device for measuring a glossiness of the recording medium;

wherein the control device decides the relationship based on a result measured by the gloss measuring device.

5. The inkjet recording apparatus of claim 3, wherein the control device decides the relationship based on a maximum overall amount of ink for printing per unit area emitted by the colored ink recording head.

6. An inkjet recording apparatus comprising:

a colored ink recording head for emitting photocurable colored ink to a recording medium;

a transparent ink recording head for emitting transparent ink to the recording medium;

a control device for controlling the colored ink recording head and transparent ink recording head;

a gloss measuring device for measuring a glossiness of the recording medium; and a selecting device for selecting a specific mode, based on a result measured by the gloss measuring device, from a plurality of modes corresponding to relationships between an amount A of colored ink for printing per unit area and an amount B of transparent ink for printing per unit area, wherein the control device controls the amount of the ink for printing per unit area emitted by the transparent ink recording head according to the selected relationship, and wherein the plurality of modes comprises:

a first mode corresponding to a relationship in which the amount B is decreased by an increase in the amount A; and a second mode corresponding to a relationship in which: (i) when the amount A is equal to or greater than a first threshold value $A_1$ and is equal to or smaller than a second threshold value $A_2$, the amount B is increased by an increase in the amount A, and (ii) when the amount A is equal to or greater than the second threshold value $A_2$ and is equal to or smaller than a third threshold value $A_3$, the amount B is decreased by an increase in the amount A.

* * * * *